US007430999B2

(12) United States Patent
Schweiger

(10) Patent No.: US 7,430,999 B2
(45) Date of Patent: Oct. 7, 2008

(54) VALVE COVER

(75) Inventor: David J. Schweiger, Pewaukee, WI (US)

(73) Assignee: Dana Automotive Systems Group, LLC, Toledo, OH (US)

( * ) Notice: Subject to any disclaimer, the term of this patent is extended or adjusted under 35 U.S.C. 154(b) by 68 days.

(21) Appl. No.: 11/352,818

(22) Filed: Feb. 13, 2006

(65) Prior Publication Data

US 2007/0186889 A1 Aug. 16, 2007

(51) Int. Cl.
*F01M 9/10* (2006.01)

(52) U.S. Cl. ..... 123/90.38; 123/195 C; 123/198 E

(58) Field of Classification Search ..... 123/90.38, 123/195 C, 198 E
See application file for complete search history.

(56) References Cited

U.S. PATENT DOCUMENTS 3,633,558 A 1/1972 Stade et al.
4,401,093 A * 8/1983 Gates et al. ..... 123/573
4,886,019 A 12/1989 Davis et al.
4,996,956 A 3/1991 Hupfer et al.
5,058,542 A * 10/1991 Grayson et al. ..... 123/90.38
5,067,449 A 11/1991 Bonde
5,090,375 A 2/1992 Hudson
5,205,243 A 4/1993 Buchholz
5,513,603 A * 5/1996 Ang et al. ..... 123/90.37
5,647,337 A 7/1997 Johnson et al.
6,098,583 A * 8/2000 Gordon ..... 123/90.38
6,216,453 B1 4/2001 Maurer
2003/0214082 A1* 11/2003 Jones et al. ..... 264/523

* cited by examiner

*Primary Examiner*—Zelalem Eshete
(74) *Attorney, Agent, or Firm*—Marshall & Melhorn LLC

(57) ABSTRACT

A valve cover is described that is secured to a component of an internal combustion engine of a vehicle. The valve cover includes a cover body having a plurality of walls defining an inner cavity and a ventilation system having a periphery. The ventilation system is at least partially disposed inside the inner cavity. A seal is molded between the cover body and the ventilation system for securing the ventilation system to the cover body.

20 Claims, 1 Drawing Sheet

VALVE COVER

TECHNICAL FIELD

The embodiments described herein are generally directed to an improved valve cover and method of sealing.

BACKGROUND

A typical piston-and-cylinder type internal combustion engine generally includes a plurality of pistons/cylinders in one or more rows as well as a cylinder head assembly. The cylinder head assembly includes a piston rod and at least one valve for each piston/cylinder, operatively associated with a respective rocker arm and a valve cover in sealing engagement with the cylinder head assembly.

The valve cover in the internal combustion engine is attached to the cylinder head assembly by fasteners and a cover gasket that ensures that the cavity that is defined by a body of the cover is adequately sealed from the surrounding atmosphere by the establishment of a seal between the marginal portion of the body of the cover and the adjacent portion of the cylinder head. Fasteners are provided to secure the valve cover to the cylinder head and to deform the ring into sealing engagement with the surfaces surrounding a dovetailed groove and into sealing engagement with the adjacent portion of the cylinder head. The sealing ring is vulcanized to the cover in an operation which follows the placing of the ring into the groove. Thus, the sealing ring is produced as a separate part which is thereupon inserted into the groove of the cover, and the sealing ring is thereupon treated to adhere to the cover. This is a time-consuming and costly operation because it involves (i) the making of a sealing ring independently of the cover; (ii) forcing the produced ring into the groove of the cover; and (iii) an additional treatment of the ring in order to ensure the establishment of an adequate seal between the ring and the cover. The sealing action of such gaskets is not entirely satisfactory, especially as concerns the seal between the ring and the cover.

Furthermore, crankcase ventilation systems or breathers may be added to the valve covers for assisting in removing vapors from the vehicle engine and preventing vapors from being expelled directly into the environment. Fabrication of such valve covers generally requires consideration of various different conditions to which the valve covers will be exposed as part of the engine of an automotive vehicle, such as vibration, thermal cycling, space considerations and the like. However, typical valve cover assemblies having a ventilation system are manufactured from stamped steel and sealed to the cylinder head assembly with a cork or a rubber gasket thereby providing inadequate sealing due to failure of the seal by vibration, thermal cycling, and inconsistent dimensions between the valve cover and the pre-manufactured seal. Therefore, there exists a need in the art to provide an improved valve cover that provides adequate sealing.

SUMMARY

In the embodiments and methods described, a valve cover is employed. The valve cover is secured to a component of an internal combustion engine of a vehicle. The valve cover includes a cover body having a plurality of walls defining an inner cavity and a ventilation system having a periphery. The ventilation system is at least partially disposed inside the inner cavity. A seal is molded between the cover body and the ventilation system for securing the ventilation system to the cover body.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION

Figure 1:
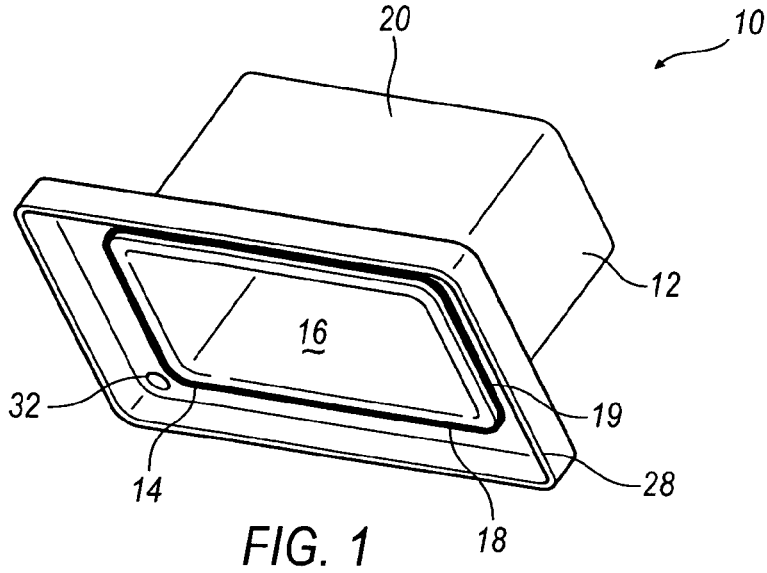
FIG. 1 is an elevational perspective view of one embodiment of a valve cover having a ventilation system.

Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limit or restrict the invention to the precise form and configuration shown in the drawings and disclosed in the following detailed description.

Referring now to FIGS. 1-4, an embodiment of a valve cover 10 having a cover body 12 suitable for attachment to an engine component (not shown) such as an engine head assembly of a vehicle is shown wherein at least a portion 14 of a ventilation system 16 or a breather insert is secured to the cover body 12. In one embodiment, the ventilation system 16 is secured to the cover body 12 at a periphery 18. The ventilation system 16 is secured by any molding method including at least one of molding the ventilation system 16 contemporaneously with securing the ventilation system 16 directly to the cover body 12; molding a seal 19 between the ventilation system 16 and the cover body 12; molding the seal 19 to the ventilation system 16; molding the seal 19 to the cover body 12; and molding the ventilation system 16 integrally with the cover body 12.

As used throughout this specification, the phrase "wall thickness" shall refer to the dimension between two surfaces of a single wall of a material. Moreover, the phrase "section thickness" shall refer to the dimension between the outside walls of a two walled part if cut by an intersecting plane. The term "contemporaneous" or any variation thereof such as "contemporaneously" as used throughout the specification is defined hereinafter to include but is not limited to: occurring generally at the same period of time.

The embodiments described herein contemplate techniques and methods for the optimization of one or more of material selection, wall thickness, and section thickness for realizing the valve cover 10 with the desired amount of strength, durability and the like. The described techniques and methods further allow the valve cover 10 to endure the various conditions such as vibration, impacts, thermal cycles and the like typically experienced within the engine of the vehicle while providing a proper seal 19 between the ventilation system 16 and the cover body 12. The skilled artisan will recognize, however, that from application to application, design requirements will vary, and therefore a reasonable amount of experimentation may be needed to adapt the various teachings to a unique intended environment. By way of example, part size, engine type and engine size may affect final design. It is believed that the use of conventional engineering techniques in combination with the present teachings will yield satisfactory results, which can be improved as desired with conventional techniques.

Figure 4:
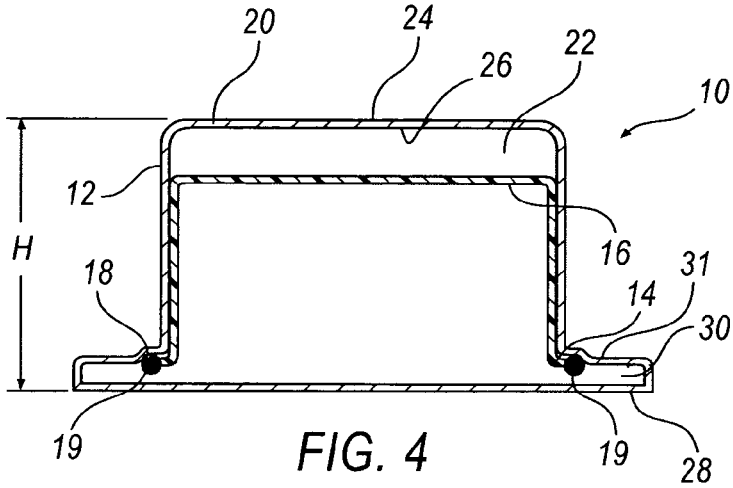
FIG. 4 is a cross-sectional view of the valve cover of FIG. 2 taken along sectional line 3-3.

The cover body 12 includes one or more walls 20 defining one or more cavities 22 within the cover body 12 of the valve cover 10. As shown in FIG. 4, the one or more cavities 22 are substantially or entirely enclosed within the cover body 12. In another embodiment, the valve cover includes a suitable insulation material (not shown) within the one or more cavities 22 for absorbing sound, vibration or both within the vehicle. The cover body 12 may be formed from steel, aluminum, plastic, polyamide resin, and the like.

Figure 2:
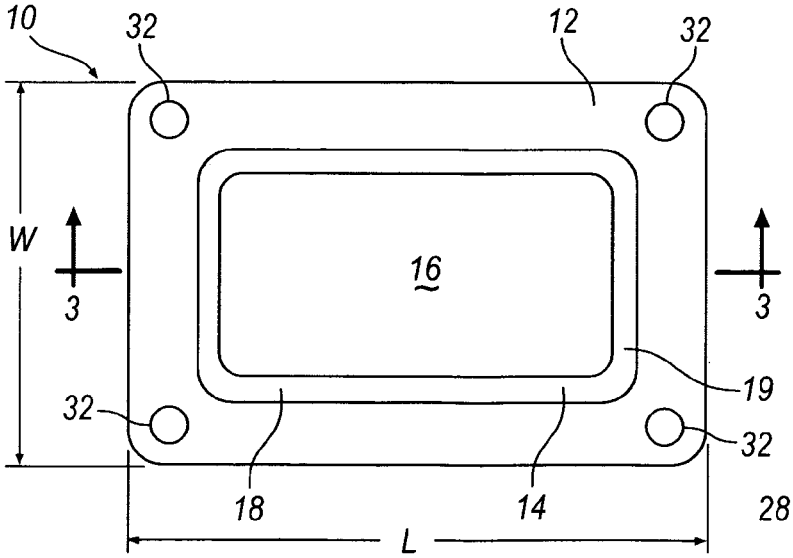
FIG. 2 is an elevated bottom view of the valve cover of FIG. 1.
Figure 3:
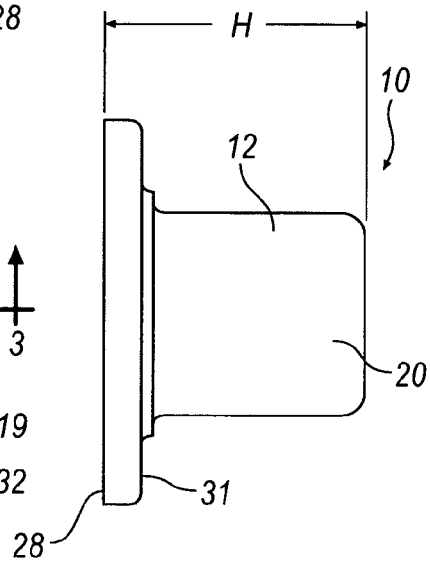
FIG. 3 is an elevational side view of the valve cover of FIG. 1.

Referring to FIGS. 2-4, the valve cover 10 has a length L, a width W, and a height H. The valve cover 10 is formed of the single substantially continuous cover body portion 12, which includes a plurality of spaced apart walls defining the substantially continuous inner cavity 22, adapted for providing thermal insulation, noise insulation, vibration dampening or some other beneficial function to the valve cover 10. The one or more walls 20 defining one or more cavities 22 within the cover body 12 further define at least one section thickness between an outer cover wall 24 and an inner cover wall 26. The section thickness may vary across the width W or remain substantially constant across the width W. In one embodiment, the cover body 12 further includes a periphery 28 that may extend outwardly from the one or more walls 20 further defining a second portion 30 of the cavity 22 and an upper periphery surface 31. The cover body 12 includes a plurality of fastener apertures 32 disposed through the upper periphery surface 31 and are adapted to receive a faster (not shown) to secure the cover body 12 to the vehicle engine component as described above.

As shown in FIG. 4, disposed between the one or more walls 20 is the ventilation system 16. In one embodiment, the ventilation system 16 may have cross-sections of a variety of shapes such as circular, square, rectangular elliptical, or otherwise shaped through which fluids including vapors from within the engine head assembly may flow. The ventilation system 16 may be substantially straight, serpentine, contoured or otherwise shaped. Additionally, the valve cover 10 may include one or more structures such as partial covers, hoses, tubes or the like for assisting in controlling fluid flow from the ventilation system 16. The ventilation system may be formed from steel, aluminum, plastic, polyamide resin, and the like.

As stated above, in one embodiment, the ventilation system 16 is secured by a method including at least one of molding the ventilation system 16 directly to the cover body 12; molding the ventilation system 16 contemporaneously with the seal 19; molding a seal 19 between the ventilation system 16 and the cover body 12; molding the seal 19 adjacent the periphery 18 of the ventilation system 16; molding the seal 19 to the cover body 12; and molding the ventilation system 16 integrally with the cover body 12. Each of these methods of sealing the ventilation system 16 to the cover body 12 allow the valve cover 10 to be produced in a cost effective manner as the parts required for assembly are reduced.

It will be appreciated that any moldable seal 19 material may be employed for accomplishing suitable contact between the cover body 12 and the ventilation system 16 to provide a proper seal. By way of example, the ventilation system 16 may be formed of a plastic material, such as but not limited to polyethylene, in order to provide the ventilation system 16 being molded directly to the cover body 12. Moreover, any suitable rigid plastic material well known maybe employed for forming the ventilation system 16 or cover body 12. Further, a convenient and cost effective valve cover 10 may be provided, that is made of plastic and has an integrally formed ventilation system 16 and structures and a minimum number of parts required for assembly.

In another embodiment, the valve cover 10 includes a coating or film on the outer cover wall 24 or the inner cover wall 26, which functions to improve the barrier properties of the cover body 12 to hydrocarbons. Such a coating of film can reduce the fugitive hydrocarbon emission from an automotive vehicle. Any coating or film which prevents the transmission of hydrocarbons through the assembly may be used. By way of example, a coating may be a carbon-silica based plasma. In another embodiment, one or more walls of the ventilation system 16 are blow molded in multiple layers wherein one of layers serves as a barrier to hydrocarbon emission. Alternatively, the ventilation system 16 may be blow molded to have a different composition at various locations of the valve cover 10.

A method of sealing the valve cover 10 of the internal combustion engine of the vehicle includes providing the cover body 12 having a plurality of walls 20 defining the inner cavity 22; inserting the ventilation system 16 at least partially into the inner cavity 22, the ventilation system 16 having a periphery 18; and securing the ventilation system 16 to the cover body 12 by molding the seal 19 between the ventilation system 16 and the cover body 12. In one embodiment, the securing of the periphery 18 includes molding the seal 19 between the ventilation system 16 and the inner cavity 22 of the cover body 12. In another embodiment; the securing of the periphery 18 includes molding the periphery 18 to the cover body 12. In another embodiment, the securing of the periphery 18 includes molding the ventilation system 16 inside the valve body 12 and securing at least a portion of the ventilation system 16 to the inner cavity 22. In yet another embodiment, the securing step includes molding the seal 19 between the cover body 12 formed from a metallic material and the ventilation system 16 also formed from a metallic material or from a plastic material. In a further embodiment, the securing step includes molding the seal 19 and the ventilation system 16 contemporaneously from the same material. The securing step provides proper sealing between the ventilation system 16 and the cover body 12 during vibration, impacts, thermal cycles and the like. Having the valve cover 12 formed from an insulation material absorbs sound and vibration within the vehicle.

The preceding description has been presented only to illustrate and describe exemplary embodiments of the methods and systems of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A valve cover secured to a component of an internal combustion engine of a vehicle comprising:

a cover body having a plurality of walls defining an inner cavity;

a ventilation system having a periphery, said ventilation system being completely disposed inside said inner cavity; and a seal molded to at least one of said cover body, said ventilation system, and both said cover body and said ventilation system, said seal adapted to provide direct sealing between said ventilation system, said cover body, and a cylinder head assembly.

2. The valve cover of claim 1, wherein said ventilation system is molded contemporaneously with said seal.

3. The valve cover of claim 1, wherein said seal is molded adjacent said periphery of said ventilation system to said cover body.

4. The valve cover of claim 1, wherein said seal is molded to said inner cavity of said cover body.

5. The valve cover of claim 1, wherein said cover body and said ventilation system are formed from a metallic material.

6. The valve cover of claim 1, wherein said cover body is formed from a metallic material and said ventilation system is formed from a plastic or a polyamide resin material.

7. The valve cover of claim 1, wherein said seal and said ventilation system are formed contemporaneously from the same material.

8. The valve cover of claim 1, wherein said valve cover is formed from an insulation material for absorbing sound and vibration within the vehicle.

9. A method of sealing a valve cover of an internal combustion engine of a vehicle comprising:

providing a cover body having a plurality of wall defining an inner cavity;

inserting a ventilation system completely into said inner cavity, said ventilation system having a periphery; and molding a seal to at least one of said ventilation system, said cover body, and both said ventilation system and said cover body, said seal adapted to provide direct sealing between said ventilation system, said cover body, and a cylinder head assembly.

10. The method of claim 9, wherein said molding includes molding said periphery to said cover body.

11. The method of claim 9, wherein said molding includes molding said ventilation system inside said valve cover and securing at least a portion of said ventilation system to said inner cavity.

12. The method of claim 9, wherein said molding includes molding said seal between said cover body formed from a metallic material and said ventilation system formed from a metallic material.

13. The method of claim 9, wherein said molding includes molding said seal between said cover body formed from a metallic material and said ventilation system formed from a plastic material.

14. The method of claim 9, wherein said molding includes molding said seal between said cover body formed from a metallic material and said ventilation system formed from a polyamide resin material.

15. The method of claim 9, wherein said molding includes molding said seal and said ventilation system contemporaneously from the same material.

16. The method of claim 9, wherein said molding provides proper sealing between said ventilation system and said cover body during vibration, impacts, and thermal cycles.

17. The method of claim 9, wherein said providing said valve cover includes forming said valve cover from an insulation material for absorbing sound and vibration within the vehicle.

18. A valve cover system secured to a cylinder head assembly of an internal combustion engine of a vehicle having a ventilation system for assisting in removing vapors from the engine comprising:

a cover body having a plurality of walls defining an inner cavity, said cover body being formed from an insulation material;

a ventilation system body having a periphery, said ventilation system body being completely disposed inside said inner cavity; and a seal molded to at least one of said cover body, said ventilation system body, and both said cover body and said ventilation system body, said seal adapted to provide direct sealing between said ventilation system. said cover body, and a cylinder head assembly;

whereby said cover body is secured to the cylinder head assembly by a plurality of fasteners.

19. The valve cover system of claim 18, wherein said cover body is formed from a metallic material and said ventilation system is formed from a plastic or a polyamide resin material.

20. The valve cover system of claim 18, wherein said seal and said ventilation system are formed contemporaneously from the same material.

* * * * *